US006022183A

United States Patent [19]

Walters et al.

[11] Patent Number: 6,022,183

[45] Date of Patent: Feb. 8, 2000

[54] MACHINE AND METHOD FOR LIFTING MASSIVE OBJECTS

[75] Inventors: James C. Walters; Kelley R. Brooks, both of Louisville, Ky.

[73] Assignee: Steel Technologies, Inc., Louisville, Ky.

[21] Appl. No.: 09/120,362

[22] Filed: Jul. 22, 1998

[51] Int. Cl.[7] ..... B66F 9/22

[52] U.S. Cl. ..... 414/607; 414/608; 414/910; 414/911; 187/234; 187/274

[58] Field of Search ..... 414/607, 608, 414/341, 908, 910, 911; 187/229, 234, 274

[56] References Cited

U.S. PATENT DOCUMENTS

| | | | |
|---|---|---|---|
| 2,545,417 | 3/1951 | Ulinski | 187/234 |
| 3,208,556 | 9/1965 | Shaffer | 187/9 |
| 3,534,664 | 10/1970 | Ulinski | 92/146 |
| 4,018,307 | 4/1977 | Ehrhardt et al. | 187/9 E |
| 4,023,650 | 5/1977 | Pleier | 187/9 R |
| 4,325,464 | 4/1982 | Larsson | 187/9 E |
| 4,593,791 | 6/1986 | Matthews | 187/9 E |
| 4,683,988 | 8/1987 | Shrum, Jr. | 187/9 E |
| 4,810,160 | 3/1989 | Emilliani et al. | 414/543 |
| 5,174,710 | 12/1992 | Dragos | 414/911 |
| 5,190,435 | 3/1993 | Epstein | 414/635 |
| 5,244,336 | 9/1993 | Engler et al. | 414/642 |
| 5,328,321 | 7/1994 | Moffett et al. | 414/631 |
| 5,330,032 | 7/1994 | Warner | 187/9 E |
| 5,636,713 | 6/1997 | Perkins et al. | 187/274 |
| 5,649,608 | 7/1997 | Sakakibara | 187/231 |

*Primary Examiner*—Dean J. Kramer
*Attorney, Agent, or Firm*—Maurice L. Miller, Jr.

[57] ABSTRACT

A mobile machine for lifting massive objects which includes a primary hydraulic cylinder whose piston chamber is hydraulically connected on a high pressure end thereof to a high pressure end of one or more secondary hydraulic lifting cylinders for operation of the lifting cylinder(s) in unison to lift the object. The total maximum effective volume of the piston chamber(s) of the secondary cylinder(s) is at least equal to the maximum effective volume of the piston chamber of the primary cylinder. The sum total effective cross-sectional area of all of the secondary cylinder piston chambers is greater than the corresponding cross-sectional area of the primary cylinder chamber to provide an output lifting force of the secondary cylinder(s) which is greater than the input force applied to a piston rod of the primary cylinder necessary to transfer hydraulic fluid from the primary cylinder to the secondary cylinder(s) to produce the enhanced output lifting force. A second embodiment of the invention permits repetitive operation of the primary cylinder to produce lifting of the secondary cylinder(s) in stages to permit use of one or more secondary cylinders having substantially greater lifting stroke distance than is possible using the preferred embodiment and, thus, increase the height to which the object can be lifted.

33 Claims, 13 Drawing Sheets

23
21
30
31
77
28
35
25
19
80

21
19
80
35
40
39
29
20a
28
61
42
12
41
46
14
84
75
16a
19
10
17
23

MACHINE AND METHOD FOR LIFTING MASSIVE OBJECTS

BACKGROUND OF THE INVENTION

This invention relates generally to a machine and method for lifting a massive object such as a coil of steel, but the machine can also be readily adapted through the use of conventional fork lift tines, for example, for lifting other objects such as palletized materials, machinery and so forth.

More specifically, this invention relates to a mobile machine and method employing a primary hydraulic cylinder to transfer hydraulic fluid, under pressure, therefrom to one or more secondary hydraulic lifting cylinders, at the same time and in equal proportions, upon operation of the primary cylinder by an auxiliary lifting device, such as a fork lift truck with its lifting tines removed, to thus operate the secondary cylinder(s) to lift a massive object with a force which is a multiple of an input force supplied to the machine by the auxiliary device.

There are many lifting machines, such as fork lift trucks, for example, which are known and used in the prior art which employ more than one hydraulic cylinder to lift massive objects. See, for example, U.S. Pat. No. 3,208,556 issued to W. M. Shaffer on Sep. 28, 1965; U.S. Pat. No. 3,534,664 issued to B. I. Ulinski on Oct. 20, 1970; and U.S. Pat. No. 4,018,307 issued to B. C. Ehrardt, et al. On Apr. 19, 1977, to mention but a few. The machines of Shaffer and Ulinski each employ a plurality of hydraulic cylinders which can be operated sequentially to lift and lower separately movable mast sections, with the forward most mast section containing a vertically movable fork lift carriage and with each movable section carrying one of the cylinders. Ulinski's machine includes a group of cylinders whose piston chambers are hydraulically connected in series wherein each cylinder is operated to lift the remaining cylinders in sequence with the forward most cylinder being operated to lift the fork lift carriage. Shaffer's machine employs cylinders which are series connected mechanically, but not hydraulically, by means of roller guides mounted on piston rods and a different chain connected over or under a peripheral portion of each guide roller between either a stationary mast section and a movable mast section containing the next cylinder or between the forward most cylinder and movable mast section in the set and the vertically movable fork lift carriage. The machine of Ehrhardt, et al. includes a cluster of three hydraulically and mechanically interconnected cylinders, all of which operate in unison, although the arrangement readily permits removal of individual cylinders from the cluster for servicing and replacement as necessary.

None of these or other known prior art machines utilize a primary cylinder hydraulically connected to one or more secondary lifting cylinders to operate the lifting cylinders in unison to obtain an output lifting force which is substantially greater than an input force needed to actuate the primary cylinder to, in turn, operate the secondary cylinder(s). Moreover, none of these prior art machines uses a primary cylinder connected hydraulically to one or more secondary cylinders in such a manner as to not only obtain an output lifting force which is a multiple of the input force needed to operate the primary cylinder, but also to permit repetitive operations of the primary cylinder in order to lift the secondary cylinder(s) in successive increments to allow use of lifting cylinders of increased total piston chamber volume over that of the primary cylinder chamber and, thus, increased lifting cylinder piston rod length and stroke distance.

By means of our invention, these and other shortcomings of prior art lifting machines are substantially eliminated.

SUMMARY OF THE INVENTION

It is an object of our invention to provide a machine and method for lifting massive objects.

It is a further object of our invention to provide a machine and method for lifting massive objects which has the capability of generating an output or lifting force which is a multiple of an externally generated input force supplied to the machine by a conventional auxiliary lifting machine such as a fork lift truck or the like.

It is another object of our invention to provide a machine for lifting massive objects which is readily movable from one point to another by means of a conventional auxiliary vehicle.

It is yet another object of our invention to provide a machine and method for lifting massive objects which includes a primary cylinder hydraulically connected to one or more secondary cylinders wherein the primary cylinder is capable of repetitive operations to operate the secondary cylinder(s) in states to permit use of secondary lifting cylinders of any desired length of piston stroke and piston rod length to increase the distance that an object can be lifted.

Briefly, in accordance with our invention, there is provided a machine for lifting massive objects featuring a lifting force multiplier effect which includes a frame, a primary hydraulic cylinder and at least one secondary hydraulic cylinder, wherein all of the cylinders are mounted on the frame. The primary cylinder includes a casing containing a piston chamber having an effective cross-sectional area $A_1$ and a piston rod which is reciprocally movable relative to the primary casing between a first position and a second position. Each secondary cylinder includes a casing containing a piston chamber, the sum total of whose effective volumes $V_2$ is at least equal to the effective volume $V_1$ of the primary chamber and the sum total of whose effective cross-sectional areas $A_2$ is greater than the area $A_1$. Each secondary cylinder also includes a piston rod which is reciprocally movable vertically relative to its corresponding casing between a fully retracted position and a fully extended position. A high pressure end of each secondary chamber is hydraulically connected to a high pressure end of the primary chamber. The machine also includes a force input assembly operatively connected to the primary piston rod for movement therewith. The force input assembly is adapted for application thereto of an externally generated force $F_1$ for moving the primary piston rod relative to the primary casing from the first position to the second position to transfer a volume of hydraulic fluid, under pressure, from the primary chamber to each secondary chamber in substantially equal proportions to move each secondary piston rod in unison from a retracted position toward the fully extended position. The machine further includes a lift carriage assembly responsively connected to each secondary piston rod for selective engagement with a massive object to be lifted. The carriage assembly is movable from a fully lowered position to a fully raised position to lift the object with an upwardly directed force $F_2$ upon movement of each secondary piston rod from a retracted position toward the fully extended position. The force $F_2$ must be at least equal to the combined weight of the carriage assembly and the object when the object is engaged for lifting and is essentially equal to the force $F_1$ multiplied by $A_2/A_1$.

These and other objects, features and advantages of the present invention will become apparent to those skilled in the art from the following detailed description and attached drawings, upon which, in way of example, only a preferred embodiment and a second important embodiment of the invention are explained and illustrated.

DESCRIPTION OF THE PREFERRED EMBODIMENT

Figure 1:
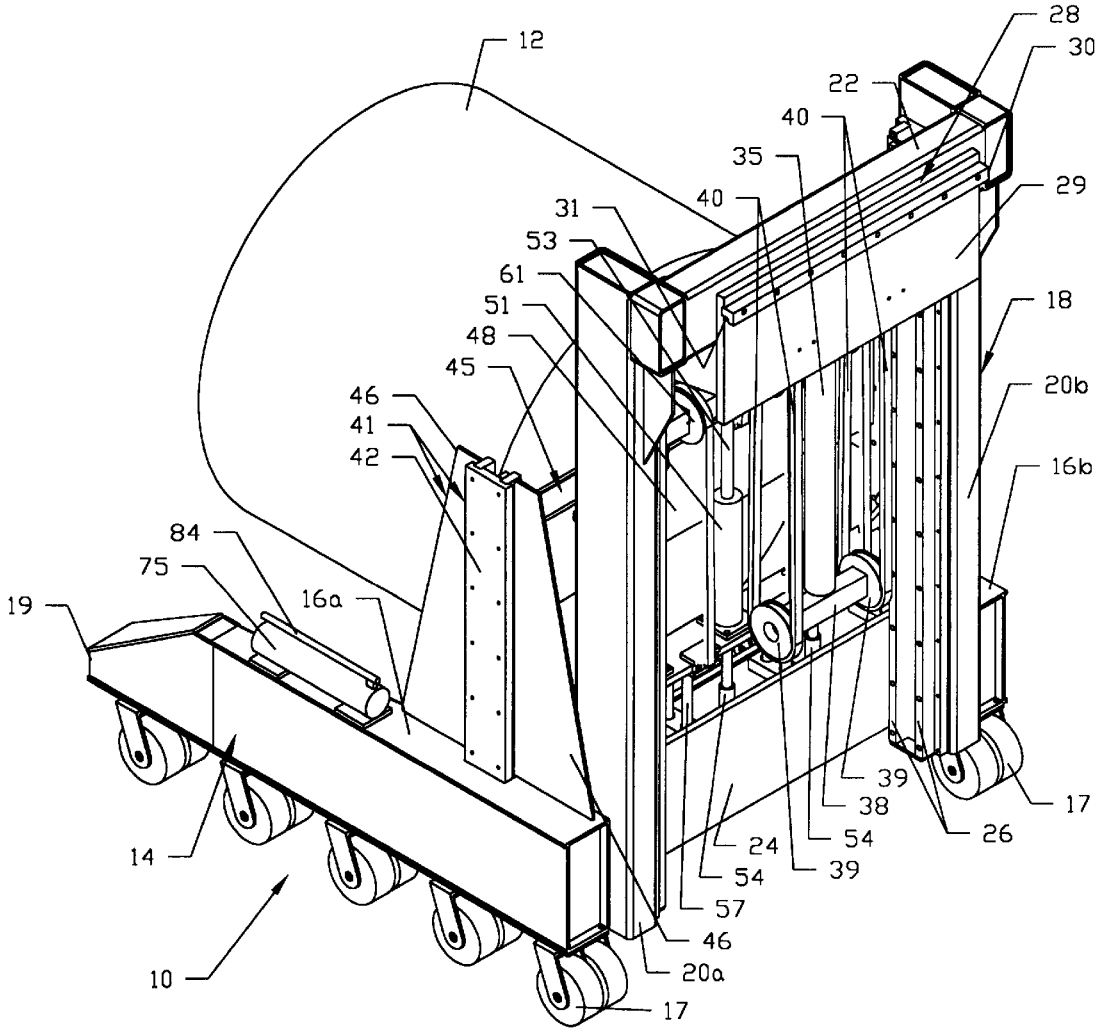
FIG. 1 shows a perspective view from a rearward viewing position of a machine for lifting a massive object, the object and a force input assembly of the machine being shown in a raised position, thus illustrating a preferred embodiment of our invention.
Figure 2:
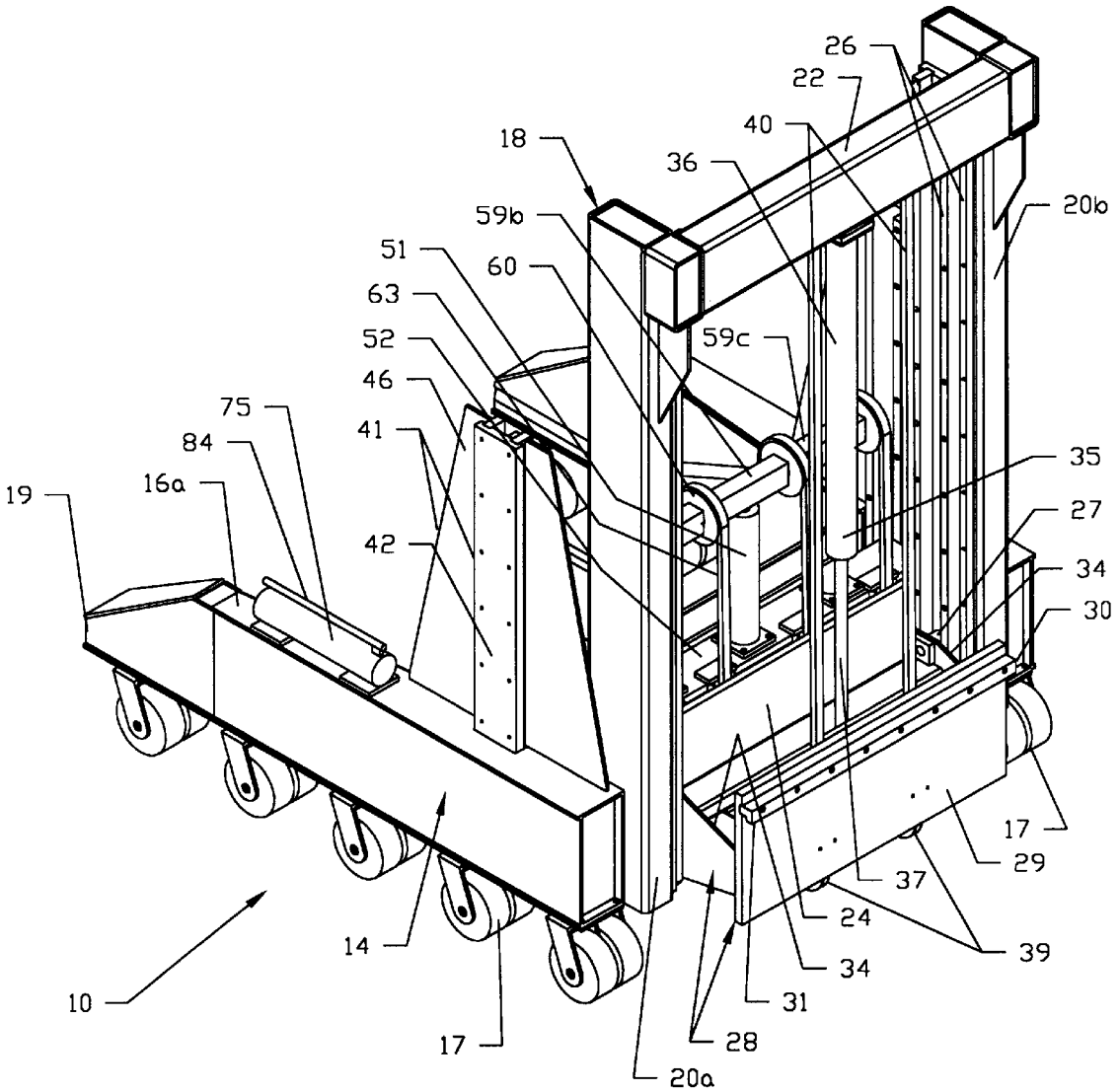
FIG. 2 shows a perspective view of the machine of FIG. 1, the same as viewed in the latter mentioned figure except with the force input assembly being shown in a lowered position and with the massive object being removed.
Figure 3:
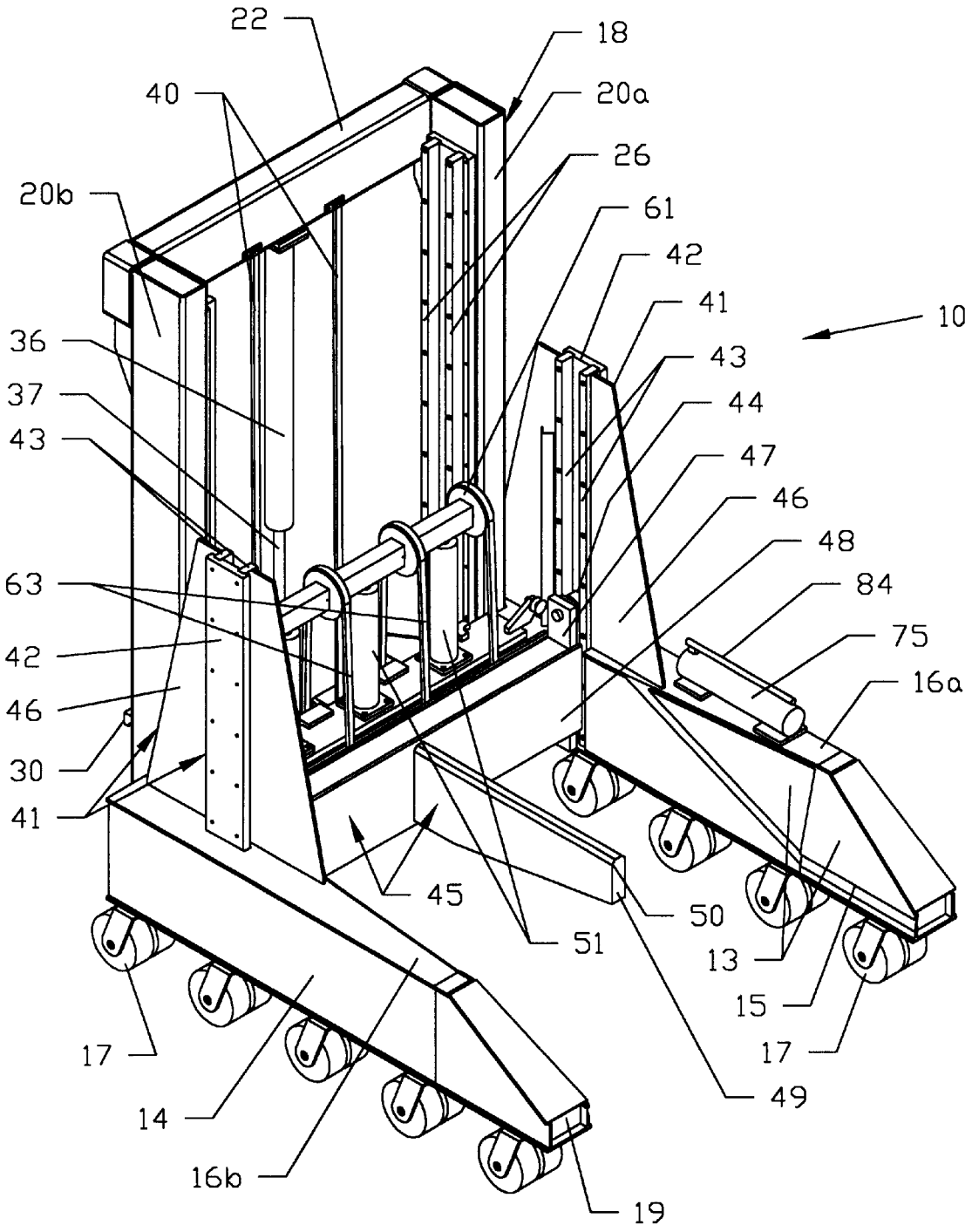
FIG. 3 shows a perspective view from a frontal viewing position of the machine of FIGS. 1–2 with a carriage assembly of the machine being shown in a lowered position.
Figure 4:
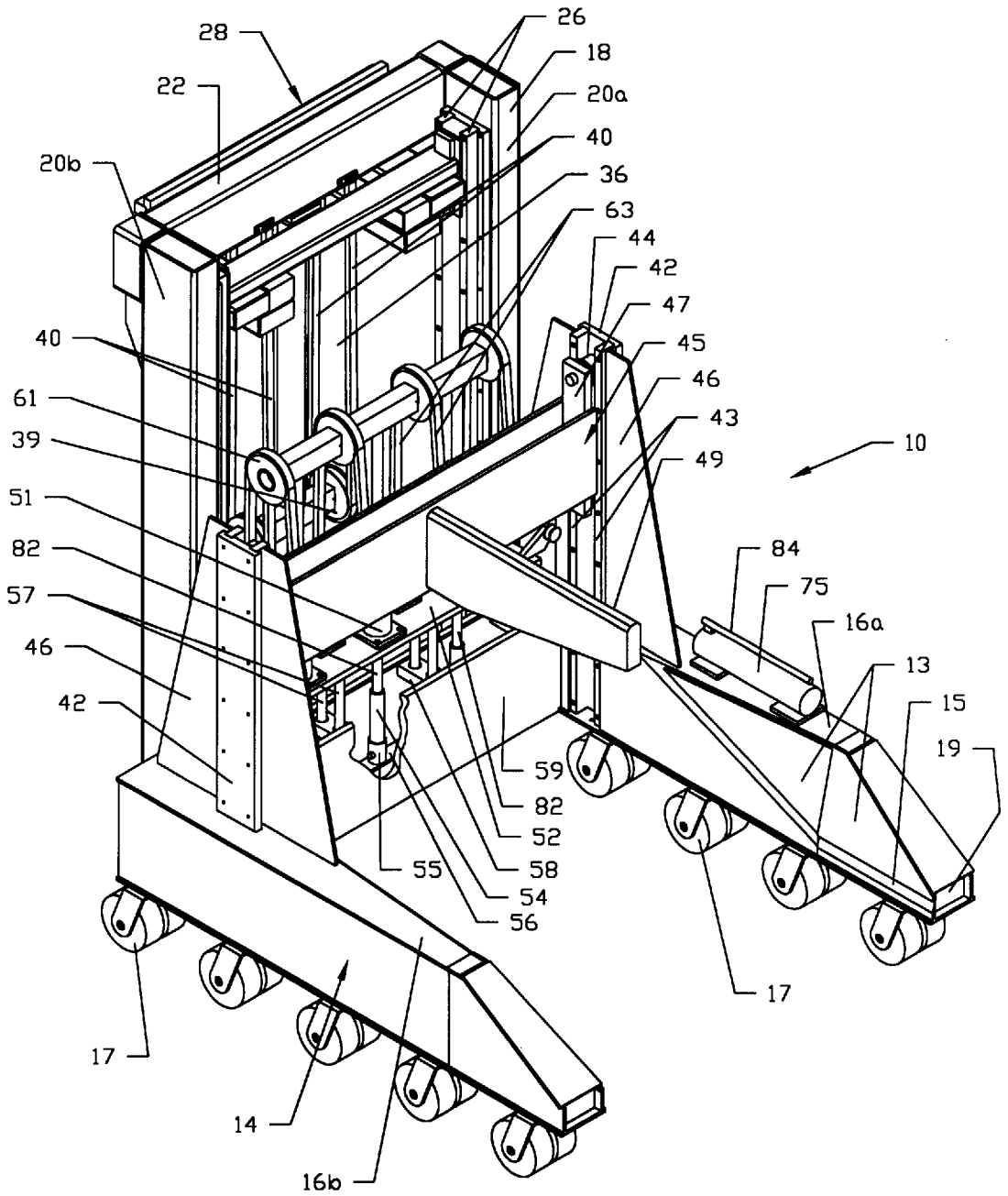
FIG. 4 shows a perspective view of the machine of FIGS. 1–3, the same as viewed in FIG. 3 except with the carriage and force input assemblies being shown in raised positions and with a part partially torn away to expose otherwise hidden structure.
Figure 5:
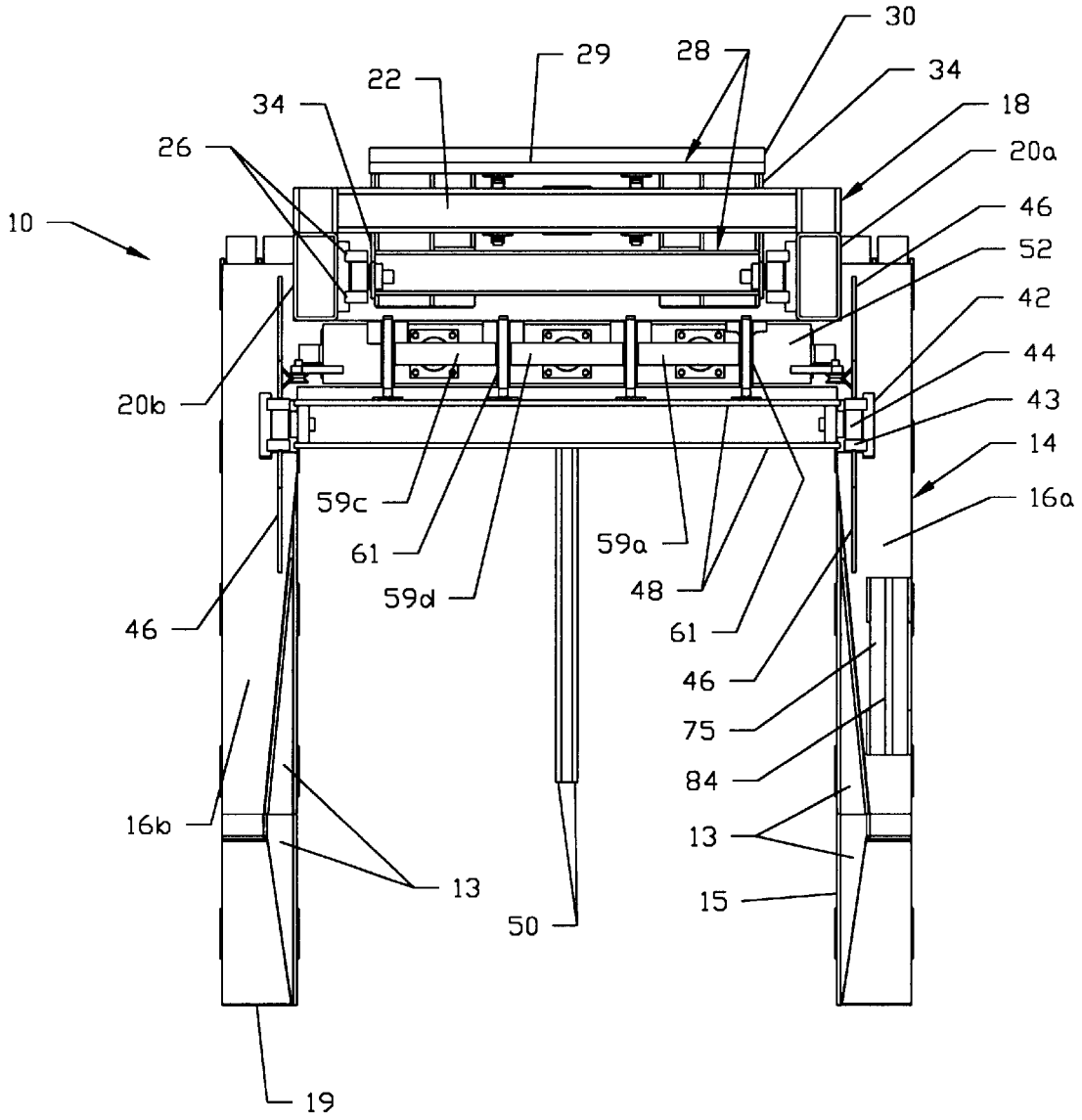
FIG. 5 shows a top plan view of the machine of FIGS. 1–4.
Figure 6:
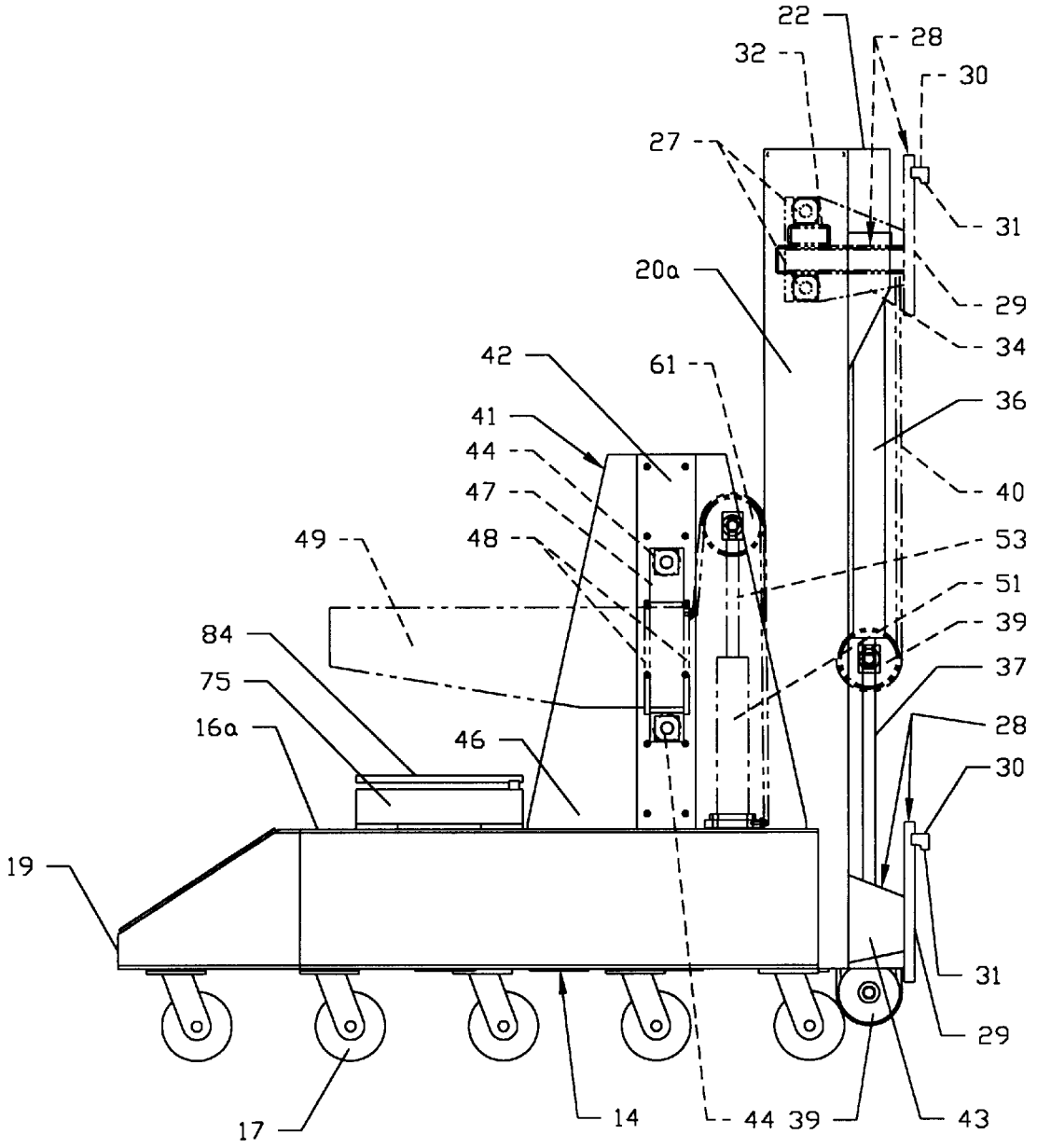
FIG. 6 shows a right side elevation view of the machine of FIGS. 1–5 with the force input assembly being shown, in full, in a lowered position and, in phantom along with the carriage element, in a fully raised position.

Referring now to the drawings and, in particular, to FIGS. 1–12 there is shown, in a preferred embodiment of our invention, a machine, generally designated 10, for lifting massive objects such as, for example, a coil 12 (FIGS. 1 and 10 only) of steel. The machine 10 includes a heavy steel frame, generally designated 14, having a pair of longitudinally extending, spaced apart side rails 16*a* and 16*b* which are joined together across a rear end portion thereof by a mast, generally designated 18, by a rear plate 24 (See, for example, FIG. 1) and by a front plate 59 (See, for example, FIG. 4). The frame 14 is thus open between the side rails 16*a* and 16*b* at a front end 19 thereof, as well as along a substantial front end portion to accommodate the coil 12 between the side rails as the machine 10 is being positioned to engage and lift it in a manner as later more fully explained. Opposing side walls 13 along front end portions of the side rails 16*a* and 16*b* are tapered upwardly and laterally outwardly from lower inside corners 15 of their bases to help prevent the rails from binding under the coil 12 as the frame 14 is moved to bring the coil between the rails preparatory to lifting. The side rails 16*a* and 16*b* each contain five aligned swivel casters 17 for supporting the frame 14 for movement of the machine 10 by an auxiliary motorized vehicle such as a conventional fork lift truck 23 (See FIG. 10). The mast 18, hereinafter referred to as the primary mast for reasons later to become evident, includes two vertically extending legs 20*a* and 20*b*, joined along upper end portions thereof by a cross beam 22 and joined along lower end portions thereof by the rear plate 24. The cross beam 22 is rearwardly offset by being attached to and between upper rearwardly facing surfaces of the legs 20*a* and 20*b*, while the rear plate 24 is attached to and between lower forwardly facing surfaces of the primary mast legs. A pair of vertically extending, spaced apart, outwardly projecting side rails 26 are formed on opposing surfaces of the legs 20*a* and 20*b* to form an opposing pair of channels for containing rollers 27 which are attached to the sides of a vertically, reciprocally movable force input assembly, generally designated 28.

The force input assembly 28 of the present example includes a plate member 29 which extends across a rear end of the frame 14 and which is spaced behind the primary mast 18. A rearwardly projecting ledge 30 having a downwardly projecting lip 31 extends horizontally across an upper end portion of a rearwardly facing surface of the plate member 29.

Figures 10, 10A:
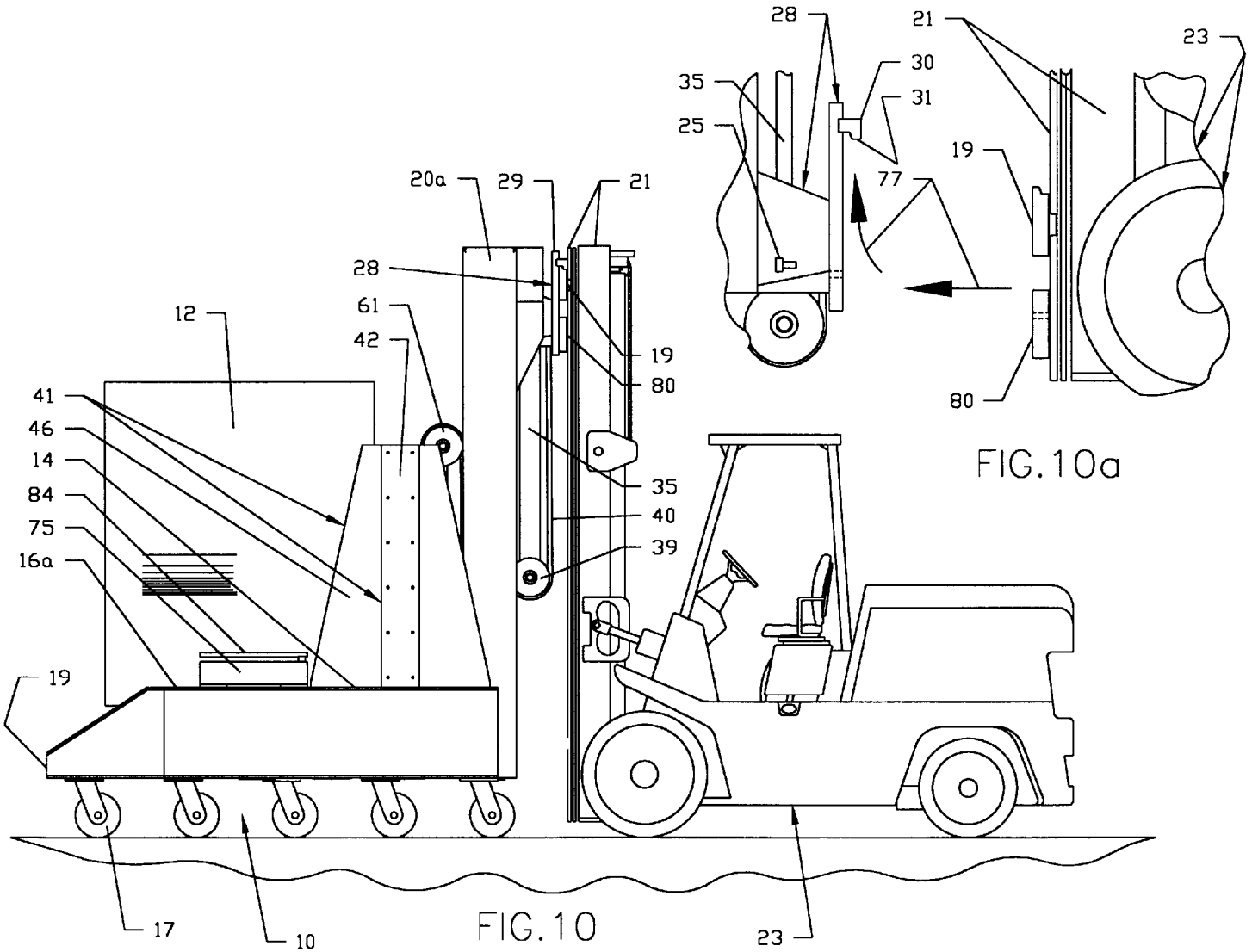
FIG. 10 shows a side elevation view of the machine of FIGS. 1–9 together with a conventional fork lift truck with lifting tines removed so that the truck's carriage brackets can fit in lifting relationship against the force input assembly, the force input assembly and a steel coil being shown in raised positions.
FIG. 10A shows an enlarged side elevation view of a portion of the machine and truck, the same as viewed in FIG. 10, except that, here, the force input assembly and a lifting carriage of the truck are separated and disposed in lowered positions.
Figure 11:
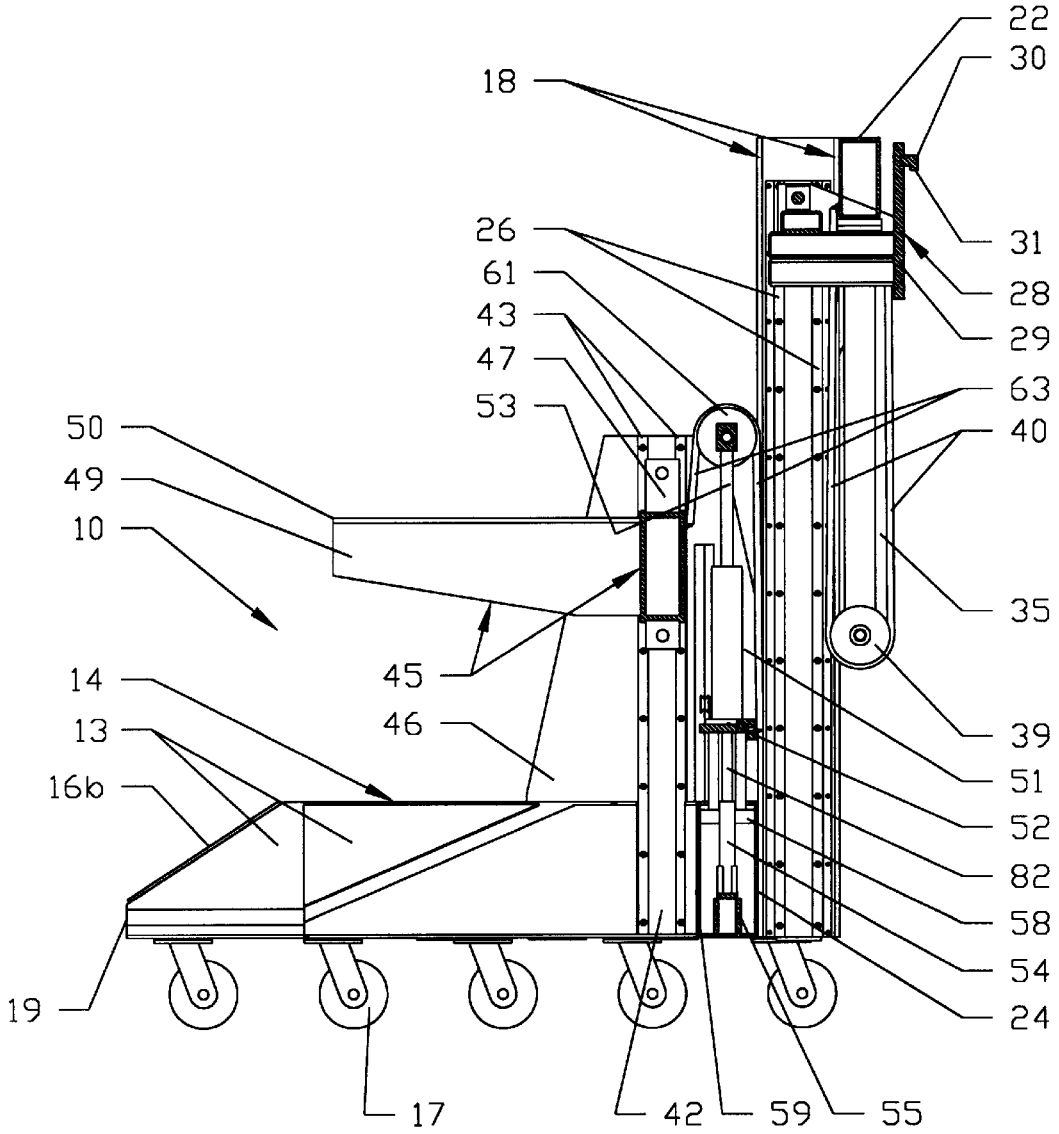
FIG. 11 shows a cross-section view of the machine of FIGS. 1–10 as viewed along cross-section lines 11—11 of FIG. 7.

The ledge 30 and lip 31 are formed so as to allow a bracket 19 on a fork lift carriage 21 of the fork lift truck 23 to fit tightly thereunder when the truck's fork lift tines have been removed to allow the force input assembly 28 of the machine 10 to be lifted from a fully lowered position (See FIG. 10A) to a fully raised position as shown in FIG. 10 and, thereafter, lowered. A hole is drilled through a lower bracket 80 of the truck 23 and plate member 29 of the machine 10 to accommodate a pin or bolt 25 to secure both members together to enable the truck to lower the force input assembly 28. The plate member 29 is attached to a beam 32 (See FIGS. 2 and 5) by means of struts 34, to opposite ends of which beam the rollers 27 are attached. A hydraulic cylinder 35, hereinafter referred to as the primary cylinder, is mounted with the base of its cylinder casing 36 secured to a lower surface of the cross beam 22 such that the cylinder is positioned in upside down fashion mid way between the mast legs 20*a* and 20*b*. A piston rod 37 of the primary cylinder 35 is connected to a bar 38, on opposite ends of which are attached to guide rollers or chain sprockets 39 (See, for example, FIGS. 1 and 6–7). A pair of elongated, flexible members, preferrably in the form of conventional leaf chains 40, extend around lower peripheral portions of the guide rollers 39 and are secured on first corresponding ends thereof to the front surface of the plate 29 of force input assembly 28 and on opposite corresponding ends thereof to a front surface of the beam 22 of the primary mast 18 (See FIG. 9).

Spaced forwardly of the primary mast 18 is a secondary mast, generally designated 41, which includes a pair of elongated, spaced apart and vertically extending steel bars 42 mounted opposite one another on the side rails 16*a* and 16*b*. A pair of elongated, spaced apart steel rails 43 (See FIGS. 3–4) keyed and bolted or, otherwise, suitably secured to inwardly facing surfaces of each of the bars 42 form a pair of opposing and vertically extending channels, each containing a pair of vertically spaced apart rollers 44. Corresponding pairs of the rollers 44 are connected to opposite sides of a lift carriage assembly, generally designated 45 (See particularly FIG. 8). A pair of trapezodially shaped steel plates 46 are mounted on each of the side rails 16*a* and 16*b* and are welded to front and rear sides of each of the rails 43 of both legs of the secondary mast 41. The lift carriage assembly 45 includes a pair of vertically extending end bars 47, to which the roller pairs 44 are connected, and a pair of spaced apart steel plates 48. An elongated steel beam or lifting horn 49 is welded to the forward most one of the plates 48 equidistant between the side rails 16*a* and 16*b* and projects forwardly for insertion into the hollow core of the coil 12 for lifting engagement with the latter. Opposite upper edges of the horn 49 are beveled, as at 50, to prevent scoring of the sheet steel of the coil 12 when engaged during lifting.

Figure 7:
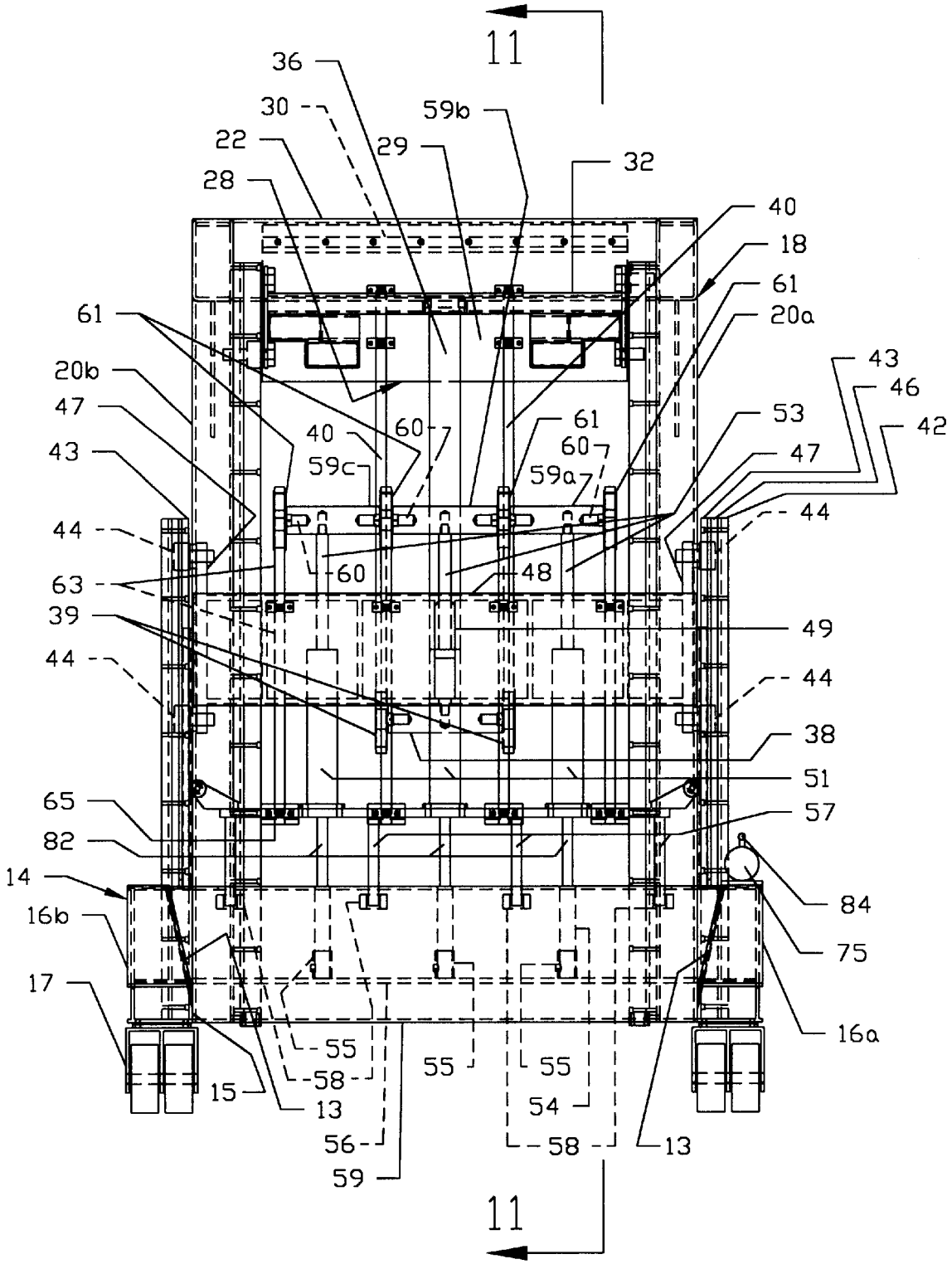
FIG. 7 shows a front elevation view of the machine of FIGS. 1–6 with the force input and carriage assemblies being shown in fully raised positions.
Figure 8:
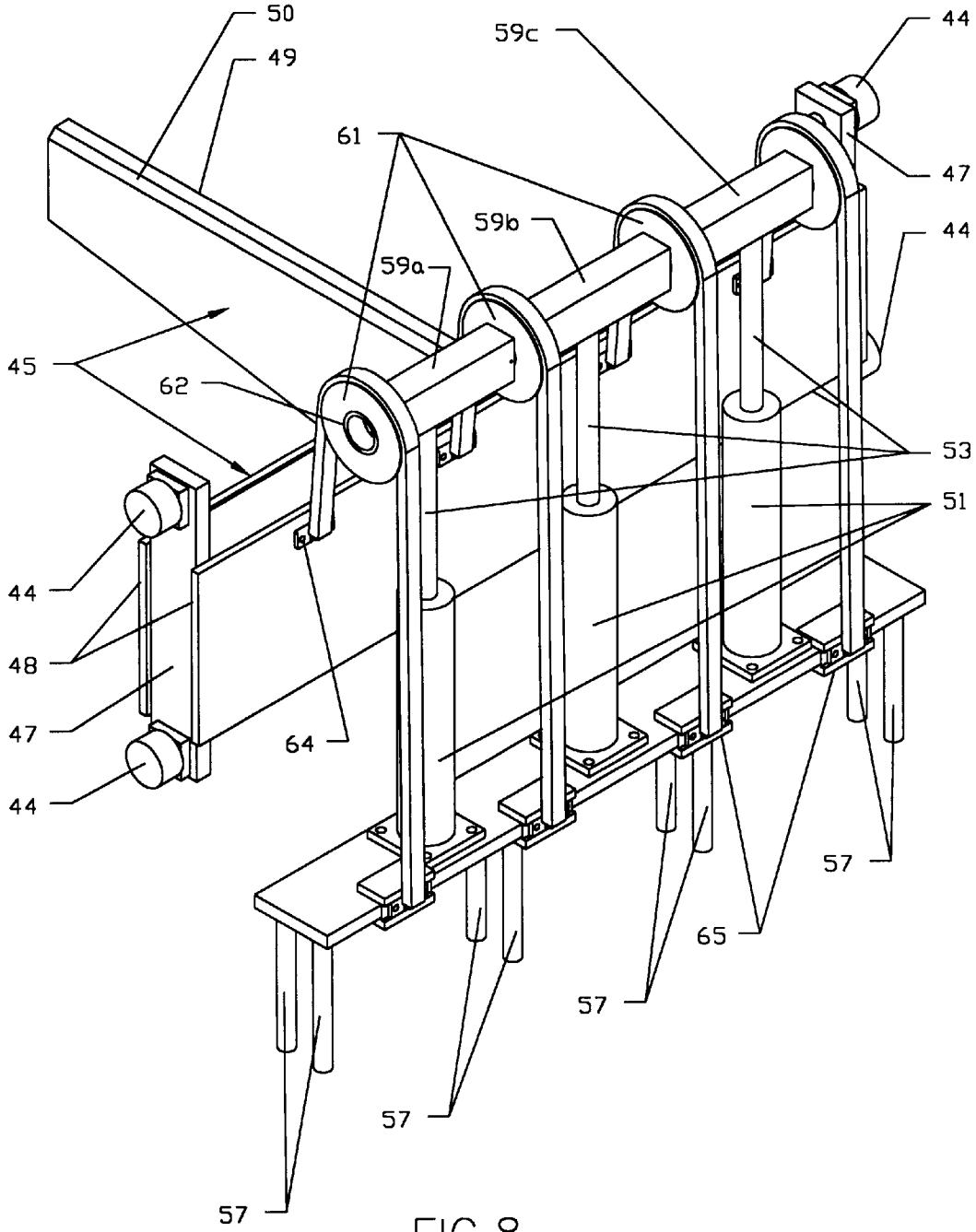
FIG. 8 shows a perspective view of a portion of the machine of FIGS. 1–7, including the carriage assembly and certain parts associated therewith.
Figure 9:
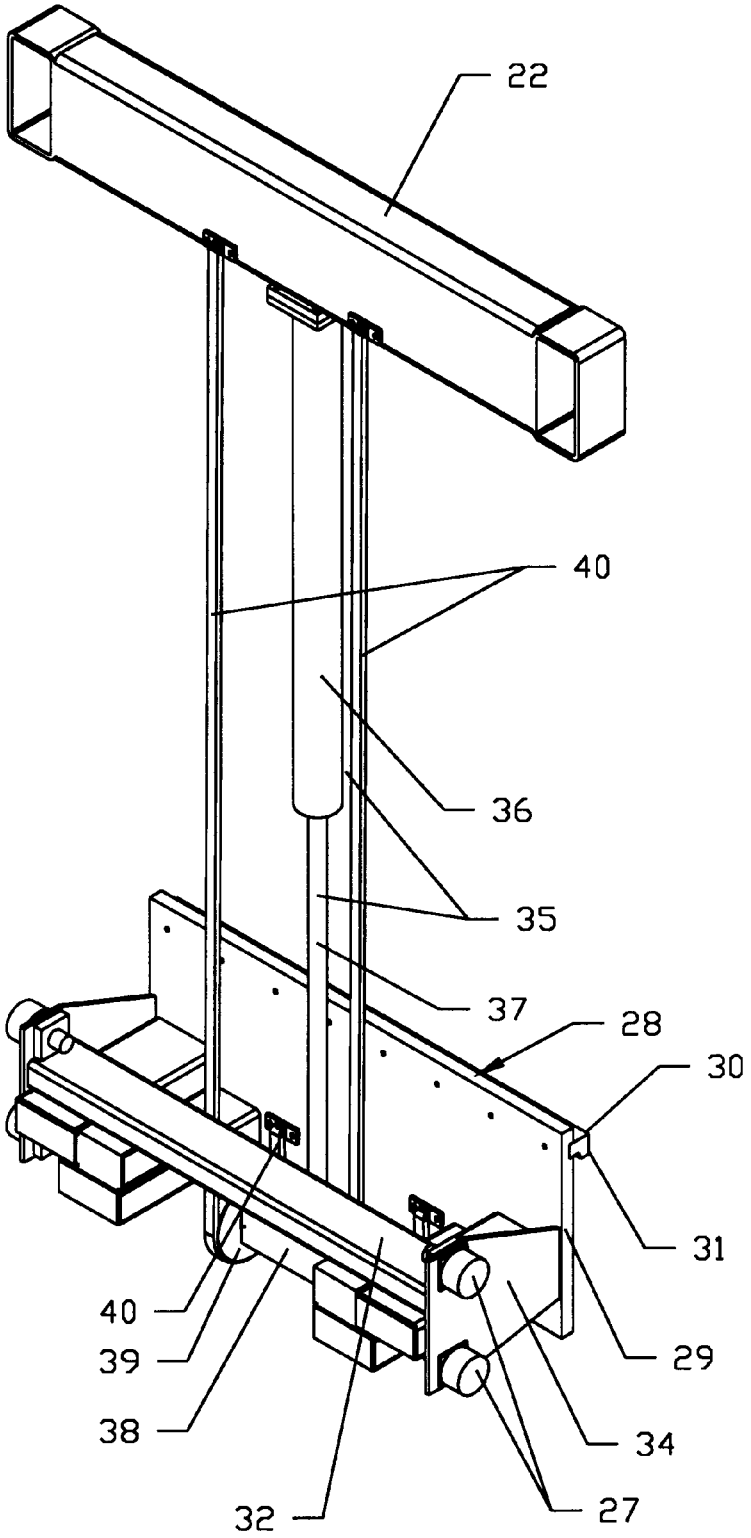
FIG. 9 shows a perspective view of a portion of the machine of FIGS. 1–7, including the force input assembly and certain parts associated therewith.

Three identical, transversely spaced apart hydraulic cylinders 51, hereinafter referred to as the secondary cylinders, are mounted on a transversely extending base plate or platform 52 (See particularly FIG. 8). The base plate 52 is, in turn, mounted on upper ends of three piston rods 82 of three identical, transversely spaced apart, hydraulic indexing cylinders 54 for vertical, reciprocal movement therewith (See FIG. 7). Base portions of the casings of the indexing cylinders 54 are seated in cylindrically shaped collars 55 which are mounted on a cross bar 56 and positioned directly under the base plate 52. The three indexing cylinder piston rods 82 are aligned vertically directly under the bases of the three secondary cylinders 51 so as to push upwardly against an underside of the secondary cylinder base plate 52 (See particularly FIG. 7). Four pairs of guide rods 57 are positioned such that one pair is located on each transverse side of each of the indexing cylinders 54, upper ends of which guide rods are inserted and welded in circular grooves formed in an underside surface portion of the plate 52 and extend vertically downwardly through slightly oversized alignment holes formed in four transversely spaced apart and longitudinally extending bars 58 (See FIGS. 4 and 7–8). The bars 58 extend between and are welded to the rear plate 24 (See FIGS. 1–2) and the front plate 59 (See FIGS. 3–4). The guide rods 57 are of sufficient length such that their lower ends never rise through their respective alignment holes in the bars 58 or above a lower surface of those bars as, even when the indexing piston rods 82 are fully extended out of the corresponding casings of the indexing cylinders 54 as best seen in FIG. 7.

The three secondary cylinders 53 are adapted to operate in unison as though they were a single cylinder, as is also permissible within the scope of this invention, since there may be as many or as few such cylinders used as desired, depending upon design requirements and the specific use for the machine 10. Accordingly, each of the secondary piston rods 53 are secured on their upper ends to the lower surface of a different one of three blocks 59*a*, 59*b*, and 59*c*. The blocks 59*a, b,* and *c* are aligned end-to-end and contain cylindrically shaped threaded steel pins 60 which are threaded into tapped blind holes formed in opposite end portions of the blocks. Four guide rollers 61, each of which contains a bushing 62 pressed therein, are mounted on the portions of the pins 60 which extend from laterally outer ends of the blocks 59*a* and 59*c* and which extend between opposing and spaced apart ends of the blocks 59*a* and 59*b* and, likewise, between opposing, spaced apart ends of the blocks 59*b* and 59*c*. Each of the guide rollers 61 contains a different flexible member 63, preferably a conventional leaf chain, which extends over an upper peripheral portion thereof between attachments 64 on first corresponding ends thereof to the rear most plate 48 and attachments 65 on second corresponding ends thereof to the secondary cylinder base plate 52 (See particularly FIG. 8). The two guide rollers 39 mounted on opposite ends of the bar 38 can be mounted in the same manner as the guide rollers 61 are mounted to the blocks 59*a*, 59*b* and 59*c*.

Figure 12:
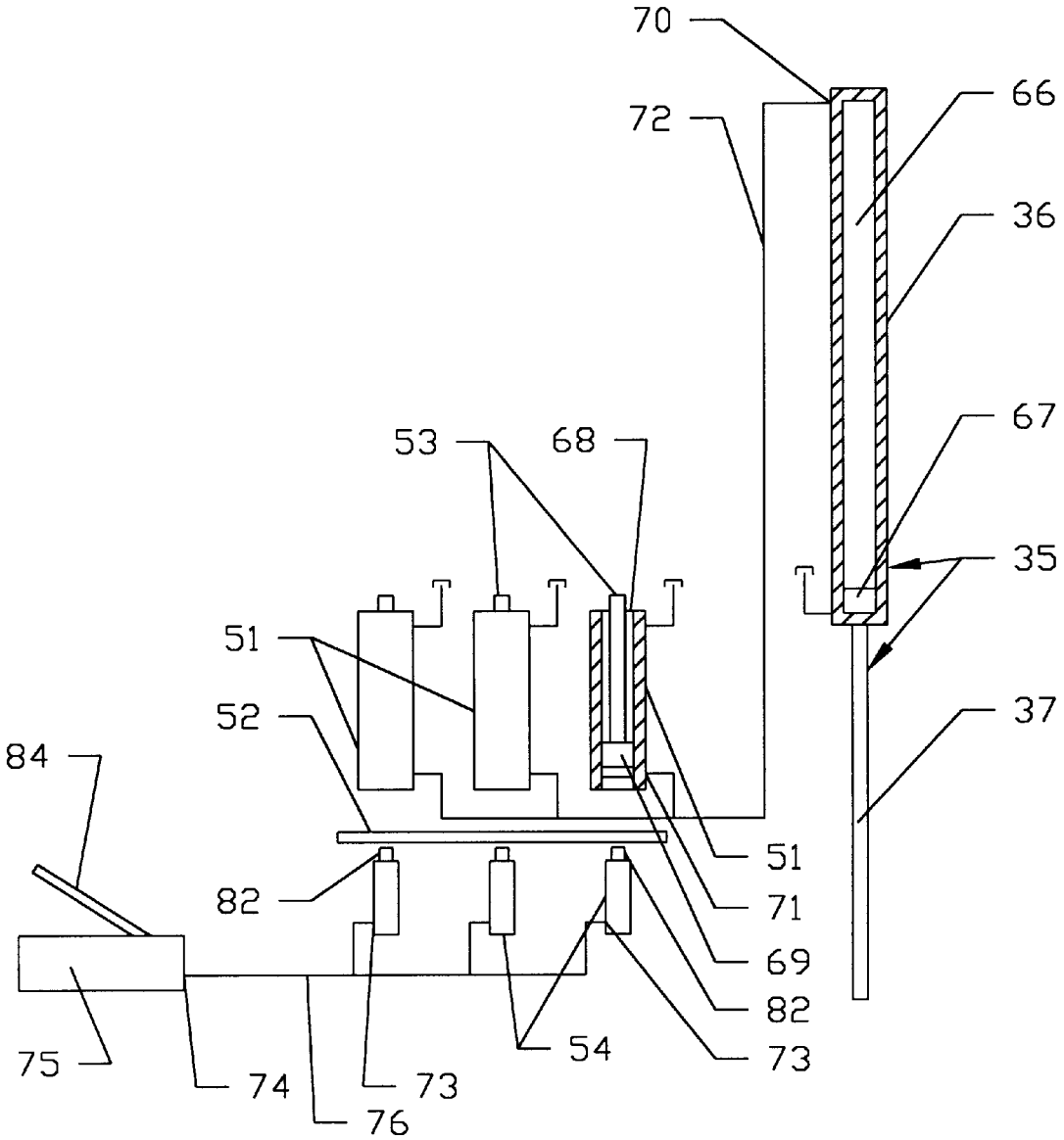
FIG. 12 shows a schematic diagram of a hydraulic fluid circuit for operation of the machine of FIGS. 1–10 according to the preferred embodiment of our invention.

Referring now in addition to FIG. 12, a hydraulic fluid circuit for operation of the machine 10 in the preferred embodiment of our invention will now be explained. The primary cylinder casing 36 is shown in FIG. 12 in cross-section so that the primary cylinder chamber 66 and primary piston 67 can be seen. Likewise, one of the three identical secondary cylinders 51 is shown in FIG. 12 with its casing in cross-section so that a secondary cylinder chamber 68 and a secondary piston 69 can be seen. A high pressure end 70 of the primary chamber 66 is connected to high pressure ends 71 of each of the chambers 68 below the pistons 69 of the secondary cylinders 51 by means of a conventional high pressure hydraulic fluid flow line 72. High pressure ends 73 of each of the hydraulic fluid chambers of the three identical indexing cylinders 54 are connected to an output port 74 of a conventional manually operated hydraulic pump reservoir 75 by means of a high pressure hydraulic fluid flow line 76. With the primary piston rod 37 in a fully extended position as shown in FIG. 12, the chamber 66 should be filled through the port 70 with hydraulic fluid to a maximum volume Vbefore the line 72 is attached thereto. In this condition, the three secondary cylinder piston rods 53 will be in their fully retracted positions, as shown, wherein the chambers 68 below the secondary pistons 69 are empty of hydraulic fluid, the force input assembly 28 is in a fully lowered position (See FIG. 2), and the lift carriage assembly 45 is also in a fully lowered position (See FIG. 3). Assume, for the time being, that the piston rods 82 of the indexing cylinders 54 are also in fully lowered positions, whereby their piston chambers are empty of hydraulic fluid.

Under these conditions, the fork lift truck 23, with its lifting tines removed, is moved so that the plate 19 fits tightly under the ledge 30 and flush against the plate member 29. See the arrows 77 in FIG. 10A. The plate 80 is then secured to the plate 29 as by means of one or more bolts 25. Thereafter, the truck 23 is moved so as to move the machine 10 until the lifting horn 49 of the carriage assembly 45 is fully inserted into the hollow core of the coil 12 to be lifted and such that the coil 12 is disposed between the side rails 16*a* and 16*b*. Next, the lift truck 23 operates to lift the plates 19 and 80 to, in turn, lift the force input assembly 28 to cause the primary piston rod 37 to move upwardly into the casing 36 to, in turn, transfer a volume $V_1$ of hydraulic fluid through the line 72 into the lower ends of the secondary cylinder chambers 68 in equal proportions. Provided that the maximum volume of the primary cylinder chamber 66 is essentially three times the maximum volume of each of the secondary chambers 68, the volume $V_1$ transferred to the secondary chambers will cause a full extension of the secondary piston rods 53 to raise the coil 12 by a maximum distance permitted by the secondary cylinders 51. If the cross-sectional area of each of the secondary chambers 68, as taken perpendicular to the longitudinal axis of each of the piston rods 53, is equal to the corresponding cross-sectional area $A_1$ of the primary chamber 66, then the total effective cross-sectional area $A_2$ of the three secondary cylinders will be three times the area $A_1$, and the force $F_2$ with which the carriage assembly 45 and coil 12 are lifted will be three times the upwardly directed force $F_1$ needed to be generated by the truck 23 to lift the force input assembly 28 and piston rod 37. Clearly, the force $F_2$ must at least be equal to the weight of the carriage assembly 45 plus that of the coil 12 and, no doubt, a bit more in order to overcome static friction and initiate such upward movement. Thus, stated mathematically:

$$F_2=F_1\times(A_2/A_1),$$

where $F_2$ is the resulting force causing upward movement of the secondary piston rods 53; $F_1$ is the force generated by the fork lift 23 to lift the input assembly 28 and primary piston rod 37; $A_2$ is the sum total of the cross-sectional areas of the three secondary cylinder chambers 68; and $A_1$ is the corresponding cross-sectional area of the primary cylinder chamber 66. Accordingly, where the sum total of the cross-sectional areas of the three secondary chambers 68 compared to the cross-sectional area of the primary chamber 66 is in a ratio of 3:1, then the resulting force $F_2$ needed to lift the carriage assembly 45 and the coil 12 is three times the required upwardly directed input force $F_1$. Where, for example, the carriage assembly 45 weights approximately 4,000 lbs., and the coil 12 to be lifted weights about 40,000 lbs., then the resulting force $F_2$ must be at least 44,000 lbs., but the input force $F_1$ generated by the fork lift 23 need only be about ⅓×40,000 lbs., or about 13,333 lbs. Clearly, then, the fork lift truck 23 needed to lift the input assembly 28 and piston rod 37 need only be large enough to lift about 14,000 to 15,000 lbs. in order for the machine 10 to lift a 40,000 lb. roll, which is a major advantage of our invention.

Of course, the price to be paid for the multiplication of the force $F_2$ over the force $F_1$ is a 3:1 trade off in lifting distance of the primary piston rod 37 as compared to that of the three secondary piston rods 53. Since the sum of the maximum volumes of the three secondary cylinder chambers 68 is equal to the maximum volume of the primary cylinder chamber 66 and since the cross-sectional areas of all four cylinders 35 and 51 are equal, in this example, the maximum upward extension of the three secondary piston rods 53 is only one-third the maximum extension of the primary piston rod 37. Depending upon the thickness of the coil 12 to be lifted, this might not be sufficient to fully raise the coil 12 off of its supporting surface for movement of the roll by the truck 23 and machine 10 from one place to another as needed. For this reason, we include the three indexing cylinders 54 with their piston rods 82 supporting the vertically movable mounting plate 52 upon which the secondary cylinders 51 are disposed. Accordingly, in those cases where the thickness of the coil 12 is so great that full extension of the piston rods 53 is not sufficient to fully lift the roll for transport purposes, as where the roll tends to sag when lifted, the conventional hand pump 84 can be used to raise the indexing piston rods 82 to increase the height of the secondary cylinder mounting plate 52 to provide additional increments of lifting distance over what can be obtained by the secondary piston rods 53 alone.

Referring now to FIGS. 1–11 and 13, there is shown, in another important embodiment of our invention, an alternative hydraulic circuit (FIG. 13) which provides certain advantages over the circuit of FIG. 12. The circuit of FIG. 13 can also be used with the machine 10 except that, in this case, there will be no need for the indexing cylinders 54, the hand pump 84 and reservoir 75 or for the vertically movable mounting plate 52 of the FIG. 12 example. Accordingly, when using this circuit, the secondary cylinders 51 can be stationarily mounted on the frame 14 for vertical, reciprocal movement of the piston rods 53 in any suitable manner, including in the manner as previously shown, although there will be no need to use the indexing cylinders 54. It is merely necessary to select the secondary cylinders 51 so as to have the length of piston rod stroke needed to lift the coil 12 to a sufficient height for transport. The circuit shows the primary cylinder 35, which is mounted in the previously explained manner and which will be operated by the force input assembly 28 and fork lift truck 23 in the same way. However, due to the repetitive operating capability of the circuit of FIG. 13, the three secondary cylinders, as now shown at 85, can have a maximum total hydraulic fluid volume $V_2$ which is much greater than the corresponding volume $V_1$ of the primary cylinder 35, such as, for example, twice as much. For this reason, the lengths of the secondary cylinders 85 will be greater than the lengths of the secondary cylinders 51 of the FIG. 12 example.

According to the circuit of FIG. 13, hydraulic fluid is supplied from a suitable reservoir or source 86, through a one-way check valve, hereinafter referred to as the reservoir check valve 87, to the high pressure end 70 of the primary cylinder 35. The high pressure end 70 is connected downstream of the reservoir check valve 87, through another check valve, hereinafter referred to as the secondary check valve 88, to high pressure ends 89 of the secondary cylinders 85 by means of hydraulic fluid flow lines 90, 91 and 92. An adjustable throttle valve 94 is connected from the line 92, downstream of the secondary check valve 88, back to the source 86 by means of a hydraulic line 95.

The circuit of FIG. 13 operates as follows. Initially, assume the piston rod 37 of primary cylinder 35 is fully extended downwardly as shown, that the chamber 66 (See FIG. 12) of the primary cylinder 35 is filled with hydraulic fluid from the source 86 to a maximum volume $V_1$, that the piston chambers of the cylinders 85 are empty so that the secondary piston rods 96 are fully retracted downwardly as shown, and that the throttle valve 94 is fully closed. Under these conditions, both the force input assembly 28 and the carriage assembly 45 of the machine 10 will be in fully lowered positions in the frame 14 at about the same level as the side rails **16*a* and 16*b*. Again, the truck 23 is positioned so that its plate 80 can be secured to the plate 29 of the machine 10 by bolts 25 or other suitable means and so that its plate 19 fits in close conformity under the ledge 30 (See FIGS. 10 and 10A). The truck 23 then moves the machine 10 so that the lifting horn 49 of the carriage assembly 45 inserts into the hollow core of the coil 12 to be lifted with the forward plate 48** flush against the flat back surface of the roll.

Next, the lift truck 23 is operated in a conventional manner to raise the plates 19 and 80 to lift both the force input assembly 28 and the primary piston rod 37 of the machine 10. As a result, hydraulic fluid is transferred, under pressure, from the primary cylinder 35, through the secondary check valve 88 and into the high pressure ends 89 of the secondary cylinders 85. The high pressure of the fluid flowing in the lines 90 and 91 during this process will maintain the reservoir check valve 87 in a closed condition. In accordance with the present example, since the maximum volume $V_1$ of the primary cylinder 35 is only one-half the total maximum volume $V_2$ of the three secondary cylinders 85, a complete retraction of the piston rod 37 into the primary cylinder casing 36 will result in an upper movement of the secondary piston rods 96 which is only one-half of their maximum movements.

If this amount of secondary piston rod extension is insufficient to lift the coil 12 clear of its supporting surface by a sufficient distance, the process can be repeated by causing the truck 23 to lower the force input assembly 28 to fully extend the primary piston rod 37 out of the casing 36. Such lowering will cause the primary cylinder piston to place a suction on the reservoir check valve 87 from the high pressure end 70 through the line 90 sufficient to open that valve and draw more hydraulic fluid from the source 86 into the cylinder 35 to refill the same. While refilling of the primary cylinder 35 is occurring, high pressure in the line 92, caused by the downwardly bearing weight of the carriage assembly 45 and partially lifted coil 12 on the secondary piston rods 96, will maintain the secondary check valve 88 in a closed condition so that no fluid is lost from the secondary cylinders 85.

After the primary piston rod 37 has been fully lowered by the truck 23, and the primary cylinder is refilled with a volume $V_1$ of hydraulic fluid, the truck 23 again raises the assembly 28 and piston rod 37 to transfer a second volume $V_1$ of hydraulic fluid to the secondary cylinders to further raise the secondary piston rods 96 to their maximum upward extension to further raise the carriage assembly 45 and coil 12. During the raising of the piston rod 37, the high pressure fluid being transferred to the secondary cylinders along the line 90 will prevent the reservoir check valve 87 from opening so that none of this fluid will be diverted back to the source 86 and all will be available to further raise the secondary piston rods 96. An air vent 97 at the lower end of the piston chamber of the primary cylinder 35 permits the piston rod 37 to be moved between an extended position and a retracted position. Likewise, air vents 98 on upper ends of the secondary cylinders 85 permit reciprocal movement of the piston rods 96. An air vent 99 on an upper end of the reservoir 86 permits hydraulic fluid to be alternately suctioned therefrom by the cylinder 35 and to be returned thereto from the secondary cylinders 85 through the throttle valve 94 and line 95 as desired.

A principle advantage of this circuit over the circuit of FIG. 12 is that there is no need to provide the indexing cylinders 54, the hand pump 84 nor for adapting the secondary cylinders 51 so that they can be lifted relative to the frame 14 as by means of the indexing cylinders or otherwise. The secondary cylinders 85 can be selected so as to have as great a lifting stroke as needed by allowing their lengths and volumes to be increased by any amount desired, since the primary cylinder 35 can be cycled through repetitive operations to transfer, in stages, as much hydraulic fluid to the secondary cylinders as needed in order to raise the piston rods 96, in increments, to their maximum extensions. To lower the secondary piston rods 96, carriage assembly 45 and coil 12, the trottle valve 94 is opened slowly to allow hydraulic fluid in the secondary cylinders 85 to be transferred back to the source 86, under pressure, due to the influence of the weight of the assembly 45 and coil 12 bearing downwardly on the piston rods 96. In practice, the weight of the carriage assembly 45 alone will ordinarily be sufficient to permit retraction of the secondary piston rods 96 upon opening of the throttle valve 94 to release hydraulic fluid from the cylinders 85. During this process, the secondary check valve 88 remains closed due to high pressure in the line 92.

Figure 13:
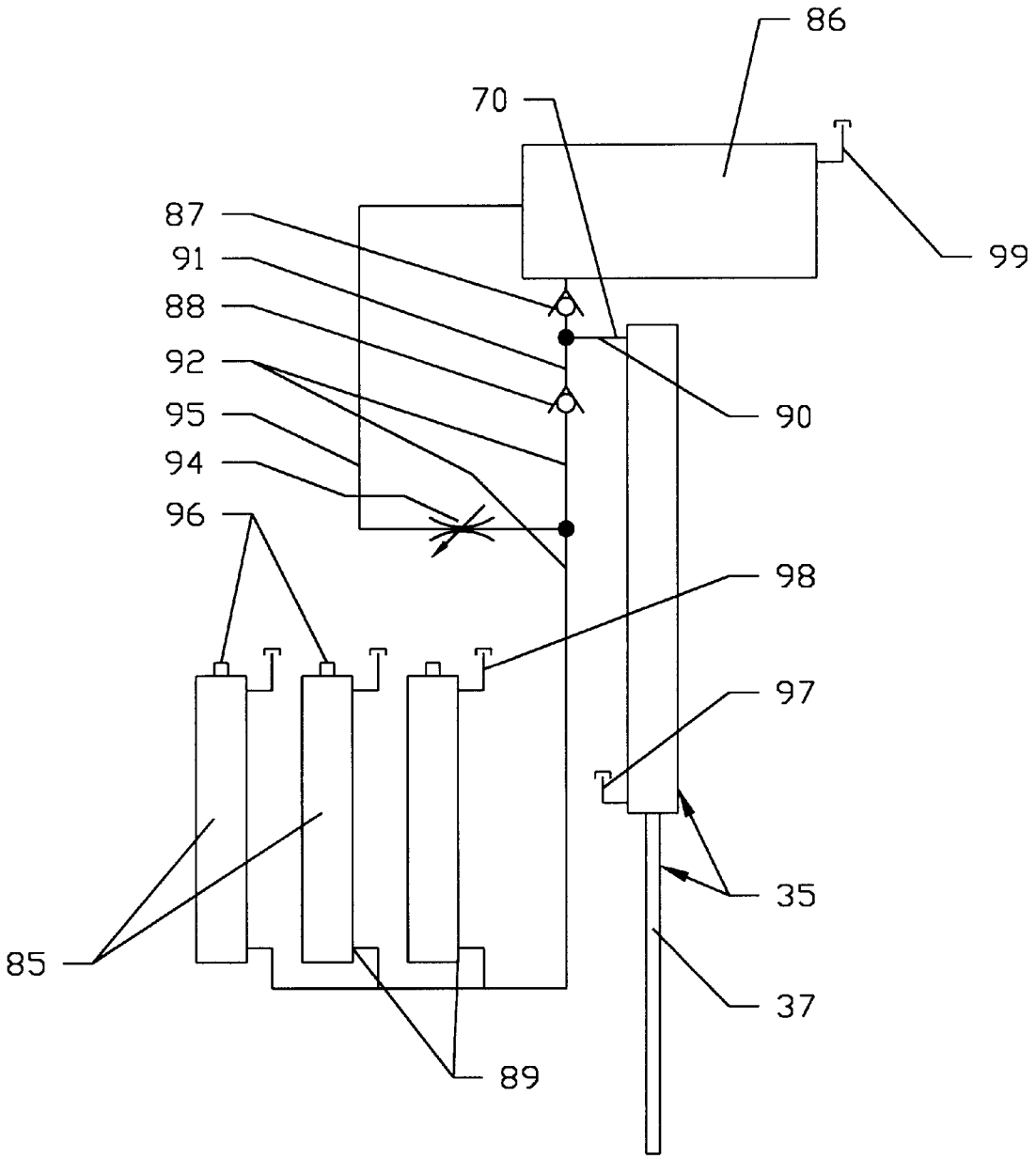
FIG. 13 shows a schematic diagram of an alternative hydraulic fluid circuit for the machine of FIGS. 1–10, thus illustrating another important embodiment of our invention.

Another major advantage of the FIG. 13 embodiment is that, unlike the example of FIG. 12, once the coil 12 has been lifted to a satisfactory height by the machine 10 and truck 23 for transport from one point to another, the force input assembly 28 can thereafter be fully lowered and the truck 23 can move the machine 10 and coil 12 with its brackets 19 and 80 (See FIG. 10A) in a fully lowered position. By contrast, in the example of FIG. 12, it is necessary after lifting the carriage assembly 45 and coil 12 to use the truck 23 to push against the force input assembly 28 to move the machine 10 and coil 12 while the assembly 28 is in a fully raised position, resulting in a sizable bending moment being placed against an upper end portion of the primary mast 18. By means of the fluid circuitry of FIG. 13 this sizable bending moment can be virtually eliminated since, in the latter example, the truck 23 can push against the force input assembly 28 while it and the bracket 19 is at approximately the same level as the side rails 16*a* and 16*b* of the frame 14. Note also that while the hydraulic fluid exchange circuitry for the primary and secondary cylinders of FIG. 12 is a closed circuit not requiring an external supply of hydraulic fluid once the chamber 66 is initially filled, the circuitry of FIG. 13 is an open circuit requiring an external supply of hydraulic fluid in storage for refilling the primary cylinder 35 for execution of the repetitive steps of operation of the circuit and machine 10 after an initial lifting operation thereof.

The check valves 87 and 88 are each of conventional type such as Model Number MCT12P as manufactured by Parker Fluidpower, Hydraulic Valve Division of Elyria, Ohio. The throttle valve 94 may be of any suitable type such as, for example, Model Number MV1600 also made by Parker Fluidpower. The primary cylinder 35 may be of any suitable type such as, for example, a 3,000 psi rated cylinder having a four inch diameter bore, a 48 inch piston rod stroke, and a 1¾ inch diameter piston rod. The secondary cylinders 51 of the preferred embodiment may be of any suitable type such as a 3,000 psi rating, containing 4 inch diameter bores, 16 inch strokes and 1¾ inch diameter piston rods. Such cylinders as at 35 and 51 in the drawings can be obtained from TMS Hydraulics of Temple, Tex. The secondary cylinders 85 of FIG. 13 may be of 3,000 psi rating, containing 4 inch diameter bores, 32 inch or longer strokes and 1¾ inch diameter piston rods. These cylinders can also be obtained from TMS Hydraulics. The three indexing cylinders 54 of the previous example may each be 10 ton, single acting, spring return cylinders with a 10⅛ inch stroke such as, for example, a Model RC-1010 made by Enerpac Corporation of Butler, Wis. The hand pump 84 is conventional and may be an Everpac Model No. P-80 or equivalent.

Although the present invention has been shown and described with respect to specific details of certain preferred and important embodiments thereof, it is not intended that such details limit the scope and coverage of this patent other than as specifically set forth in the following claims.

We claim:

1. A machine for lifting massive objects featuring a lifting force multiplier effect comprising a frame;

a primary hydraulic cylinder mounted on said frame including a casing containing a piston chamber having an effective cross-sectional area $A_1$ and a piston rod which is reciprocally movable relative to said primary casing between a first position and a second position;

at least one secondary hydraulic cylinder mounted on said frame, each said secondary cylinder including a casing containing a piston chamber, the sum total of whose effective volumes $V_2$ is at least equal to the effective volume $V_1$ of said primary chamber and the sum total of whose effective cross-sectional areas $A_2$ is greater than the area $A_1$, each said secondary cylinder also including a piston rod which is reciprocally movable vertically relative to its corresponding casing between a fully retracted position and a fully extended position, a high pressure end of each said secondary chamber being hydraulically connected to a high pressure end of said primary chamber;

a force input assembly operatively connected to said primary piston rod for movement therewith and being adapted for application thereto of an externally generated force $F_1$ for moving said primary piston rod relative to said primary casing from said first position to said second position to transfer a volume of hydraulic fluid, under pressure, from said primary chamber to each said secondary chamber in substantially equal proportions to move each said secondary piston rod in unison from a retracted position toward said fully extended position; and a lift carriage assembly responsively connected to each said secondary piston rod for selective engagement with a massive object to be lifted, said carriage assembly being movable from a fully lowered position to a fully raised position to lift said object with an upwardly directed force $F_2$ upon movement of each said secondary piston rod from said fully retracted position to said fully extended position, the force $F_2$ being at least equal to the combined weight of said carriage assembly and said object, when engaged for lifting, and being essentially equal to the force $F_1$ multiplied by $A_2/A_1$.

2. The machine of claim 1 wherein said carriage assembly and said object are of sufficient combined weight to cause each said secondary piston rod to move from said extended position to said retracted position by gravitation to, in turn, transfer said hydraulic fluid, under pressure, from each said secondary chamber to said primary chamber to, in turn, move said primary piston rod relative to said primary cylinder from said second position to said first position upon removal of said force $F_1$ from said force input assembly.

3. The machine of claim 1 wherein said carriage assembly is of sufficient weight to cause each said secondary piston rod to move from said extended position to said retracted position by gravitation to, in turn, transfer hydraulic fluid from each said secondary chamber to said primary chamber to, in turn, move said primary piston rod relative to said primary cylinder from said second position to said first position upon removal of said force $F_1$ from said force input assembly.

4. The machine of claim 1 wherein said frame is mobile.

5. The machine of claim 1 wherein said force input assembly comprises a plate member having a rearwardly facing surface, said plate member being vertically and reciprocally movably attached to said frame; and a horizontally extending ledge attached to said plate member and projecting rearwardly of said rearwardly facing surface for application thereto of said force $F_1$ in an upward direction, said plate member being operatively associated with said primary piston rod to move in said upward direction upon application of said force $F_1$ to said ledge to, in turn, move said primary piston rod relative to said primary cylinder from said first position to said second position, said plate member being responsively associated with said primary piston rod to move in a downward direction in response to movement of said primary piston rod relative to said primary cylinder from said second position to said first position in the absence of an externally applied, upwardly directed force being applied to said ledge.

6. The machine of claim 5 further comprising a vertically extending primary mast fixedly mounted on said frame, said force input assembly being vertically and reciprocally movably attached to said primary mast so as to be movable between a lower position opposite a base portion of said primary mast and a raised position opposite an upper end portion of said primary mast, a base of said primary cylinder being stationarily attached to an upper end portion of said primary mast;

at least one primary roller guide responsively connected to an outer end of said primary piston rod; and a primary flexible member for each said primary roller guide connected between said force input assembly and an upper end portion of said primary mast, each said flexible member extending on and around a portion of the periphery of a different one of each said primary guide such that said plate member is disposed in said lower position when said primary piston rod is in said first position, said primary piston rod being movable relative to said primary cylinder from said first position to said second position in response to movement of said force input assembly from said lower position to said raised position upon application of said force $F_1$ upwardly against said ledge.

7. The machine of claim 6 wherein each said primary flexible member comprises a leaf chain.

8. The machine of claim 6 wherein said primary mast is fixedly mounted on a rear end portion of said frame.

9. The machine of claim 5 wherein said plate member is generally rectangularly shaped, is rearwardly spaced from a rear end of said frame and extends substantially across a rear end of said frame.

10. The machine of claim 5 wherein said frame is mobile and movable by means of a horizontally directed, externally generated force being applied to said plate member when said primary piston rod is disposed in said second position.

11. The machine of claim 5 further comprising a vertically extending primary mast stationarily mounted on said frame, said plate member being vertically and reciprocally movably attached to said primary mast so as to be movable between a lower position opposite a base portion of said primary mast and a raised position opposite an upper end portion of said primary mast, a base of said primary cylinder being fixedly attached to an upper end portion of said primary mast such that said primary piston rod extends downwardly out of said primary casing;

at least one primary roller guide responsively connected to an outer end of said primary piston rod for movement therewith; and a primary flexible member for each said primary roller guide connected between said plate member and an upper end portion of said primary mast and extending on and around a portion of the periphery of a corresponding one of said primary guide such that said plate member is disposed in said lower position when said primary piston rod is in said fully extended position, said primary piston rod being movable from said fully extended position to said fully retracted position in response to movement of said plate member from said lower position to said raised position upon application of said force $F_1$ upwardly against said ledge.

12. The machine of claim 11 wherein said primary mast is fixedly mounted on a rear end portion of said frame in front of said plate member.

13. The machine of claim 1 further comprising a secondary mast fixedly mounted on said frame and including a pair of transversely spaced apart, vertically extending legs, said legs being laterally spaced from said at least one secondary cylinder, said carriage assembly being reciprocally movably mounted between said secondary mast legs and projecting forwardly therefrom for vertical reciprocal movement between upper and lower end portions of said secondary mast in response to like movements of said secondary piston rod;

at least one secondary roller guide responsively connected to an outer end of said secondary piston rod for vertical, reciprocal movement therewith; and a secondary flexible member for each said roller guide connected between said carriage assembly and said frame, each said secondary flexible member extending on and around a portion of the periphery of a different one of said at least one secondary guide such that said carriage assembly is disposed in said fully lowered position in said frame when each said secondary piston rod is in said fully retracted position and is disposed in said fully raised position when each said secondary piston rod is disposed in said fully extended position.

14. The machine of claim 13 wherein each said secondary flexible member comprises a leaf chain.

15. The machine of claim 13 wherein said secondary mast is fixedly mounted on a central portion of said frame.

16. The machine of claim 1 wherein said at least one secondary cylinder comprises three identical hydraulic cylinders mounted on said frame, the high pressure ends of the chambers of said three cylinders being hydraulically connected together for operation of said three cylinders in unison.

17. The machine of claim 16 wherein said total combined effective volume of the three chambers of said three secondary cylinders is at least equal to the effective volume of said primary cylinder chamber and wherein the total combined effective cross-sectional area $A_2$ of the three secondary cylinder chambers is approximately three times the corresponding effective cross-sectional area $A_1$ of said primary cylinder chamber, such that the force $F_2$ is approximately three times greater than the required input force $F_1$ for a given weight of said carriage assembly and object.

18. The machine of claim 1 further comprising at least one hydraulic indexing cylinder stationarily mounted on said frame below said at least one secondary cylinder, each said indexing cylinder including an indexing cylinder chamber and an indexing piston rod which is vertically reciprocally movable between an extended position and a retracted position;

a platform mounted on an outer end of each said indexing piston rod for movement therewith, a base of said at least one secondary cylinder being mounted on said platform;

means for selectively pumping a quantity of a hydraulic fluid from a reservoir to each said indexing cylinder chamber to selectively raise said indexing cylinder rod, platform and said at least one secondary cylinder to a desired level between a lower indexing position to an upper indexing position relative to said frame to selectively adjust the vertical height of said carriage assembly above a supporting surface of said frame when each said secondary piston rod is disposed in either said fully retracted position or said extended position; and means for selectively draining a quantity of hydraulic fluid from each said indexing chamber in equal proportions to selectively lower said indexing cylinder rod, platform and said at least one secondary cylinder to a desired level between said upper indexing position and said lower indexing position.

19. The machine of claim 18 wherein said at least one indexing cylinder comprises three identical hydraulic cylinders, said pumping means being connected to supply equal quantities of a hydraulic fluid to each of said identical indexing cylinders per unit of time and said draining means being connected to drain equal quantities of a hydraulic fluid from said identical indexing cylinders per unit of time for operation of said identical indexing cylinders in unison.

20. The machine of claim 18 further comprising a container for hydraulic fluid being mounted on said frame to serve as said reservoir, said reservoir being hydraulically connected to each said indexing cylinder chamber, said pumping means comprising a manually operated pump.

21. The machine of claim 1 wherein said frame comprises a pair of elongated, transversely spaced apart side rails extending between an open front end and a rear end portion of said frame; and a transverse member adjoining said side rails between rear end portions of said side rails, said carriage assembly having a lifting arm which is medially spaced between said side rails for engaging and lifting said object when said object is disposed at least partially between front end portions of said side rails.

22. The machine of claim 21 wherein opposing sides of front end portions of said pair of side rails are tapered upwardly and laterally outwardly from one another to aid in avoiding binding between said pair of side rails and a massive object to be lifted comprising a coil of sheet steel when said coil is disposed between said side rails for engagement with said carriage assembly.

23. The machine of claim 1 further comprising a series of casters rollably and swivelly attached to and supporting said frame.

24. The machine of claim 23 wherein said series comprises five pairs of casters.

25. The machine of claim 1 wherein said frame is mobile and movable by means of a horizontally directed, externally generated force being applied to said force input assembly when said primary piston rod is disposed in said second position.

26. A machine for lifting massive objects comprising a frame;

a primary hydraulic cylinder mounted on said frame including a hydraulic cylinder chamber having a volume $V_1$ and an effective cross-sectional area $A_1$, said primary cylinder also having a piston rod which is reciprocally movable relative to said primary cylinder between a first position and a second position;

at least one secondary hydraulic cylinder mounted on said frame, each said secondary cylinder having a hydraulic cylinder chamber, the sum total of whose volumes $V_2$ is greater than the volume $V_1$ and the sum total of whose effective cross-sectional areas $A_2$ is greater than the area $A_1$, each said secondary cylinder also having a piston rod which is reciprocally movable vertically between a retracted position and a fully extended position;

a reservoir check valve connected for one-way flow of a hydraulic fluid from a hydraulic fluid source to a high pressure end of said primary cylinder chamber;

a secondary check valve connected for one-way flow of a hydraulic fluid from said high pressure end of said primary cylinder chamber to a high pressure end of each said secondary chamber;

an adjustable throttle valve connected for one-way flow of a hydraulic fluid upon command from said high pressure end of each said secondary chamber, downstream of said secondary check valve, to said source;

a force input element operatively associated with said primary piston rod and being adapted for application thereto of an externally generated force $F_1$ for moving said primary piston rod relative to said primary cylinder from said first position to said second position to, in turn, transfer a quantity of a hydraulic fluid from said primary chamber through said secondary check valve to each said secondary chamber to move each said secondary piston rod in unison from a retracted position toward said fully extended position, said force input element also being operatively associated with said primary piston rod to move said primary piston rod from said second position to said first position to draw, by suction, a volume $V_1$ of a hydraulic fluid from said source through said reservoir check valve to fill said primary chamber; and a carriage assembly responsively associated with each said secondary piston rod for movement therewith from a lowered position toward a fully raised position, said carriage assembly being adapted for engagement with a massive object for lifting said object, said carriage assembly being operatively associated with each said piston rod for moving each said secondary piston rod gravitationally and in unison from a raised position to said lowered position upon release of a hydraulic fluid from each said secondary chamber through said throttle valve.

27. A method for lifting a massive object, the steps of which comprise providing a movable frame, primary hydraulic cylinder and at least one secondary hydraulic cylinder mounted on said frame, the total maximum volume $V_2$ of all piston chambers of said at least one secondary cylinder being at least equal to a maximum volume $V_1$ of a piston chamber of said primary cylinder, the total cross-sectional area $A_2$ of all said secondary piston chambers being greater than a corresponding cross-sectional area $A_1$ of said primary cylinder chamber, high pressure ends of all said secondary chambers being hydraulically connected to a high pressure end of said primary chamber;

providing a force input assembly connected to a piston rod of said primary cylinder for reciprocal movement therewith between a first extreme position and a second extreme position, and a carriage assembly connected to each piston rod of said at least one secondary cylinder for vertical, reciprocal movement with joint and corresponding movement of each said secondary piston rod;

placing said primary piston rod and force input assembly in said first position with a full volume $V_1$ of hydraulic fluid in said primary piston chamber and with each said secondary piston chamber being empty;

moving said frame such that said carriage assembly is brought into lifting engagement with a massive object to be lifted; and applying an input force $F_1$ in a first direction to said force input assembly to move said force input assembly and said primary piston from said first position to said second position relative to said frame and primary cylinder, respectively, to transfer said volume $V_1$ of hydraulic fluid from said primary chamber to each said secondary chamber in equal proportions to, in turn, extend each said secondary piston rod upwardly in unison to lift said carriage assembly and object.

28. The method of claim 27, the steps of which further comprise applying a second force to said force input assembly to move said frame and object from one location to another after the step of applying and while maintaining said force $F_1$ on said force input assembly to hold said primary piston rod in said second position and said object in a lifted condition.

29. The method of claim 27, the steps of which further comprise removing said force $F_1$ from said force input assembly and applying a third force to said force input assembly in a direction opposite that of said force $F_1$ to move said force input assembly and primary piston rod from said second position back to said first position to permit the transfer of the volume $V_1$ of said hydraulic fluid back to said primary piston chamber from each said secondary piston chamber under the influence of the weight of said carriage assembly and object bearing on each said secondary piston rod to thus lower said carriage assembly and object from a raised position to a lowered position.

30. A method for lifting a massive object, the steps of which comprise (A) providing a movable frame, a primary hydraulic cylinder and at least one secondary hydraulic cylinder mounted on said frame, the total maximum volume $V_2$ of all piston chambers of said at least one secondary cylinder being greater than a maximum volume $V_1$ of a piston chamber of said primary cylinder, the total cross-sectional area $A_2$ of all said secondary piston chambers being greater than a corresponding cross-sectional area $A_1$ of said primary cylinder chamber;

(B) providing a source of hydraulic fluid containing more of said fluid than necessary to fill said primary chamber to said volume $V_1$, a force input assembly connected to a piston rod of said primary cylinder for reciprocal movement therewith between a first extreme position and a second extreme position, and a carriage assembly connected to each piston rod of said at least one secondary cylinder for vertical, reciprocal movement with joint and corresponding movement of each said secondary piston rod, a high pressure end of said primary cylinder chamber being hydraulically connected to said source for only one-way flow of said fluid from said source to said primary chamber, said primary chamber high pressure end also being hydraulically connected to high pressure ends of said secondary cylinder chambers for only one-way flow of said fluid from said primary chamber to all said secondary chambers, said high pressure ends of said secondary chambers also being hydraulically connected to said source for selective release and one-way flow of said fluid from said secondary chambers to said source;

(C) placing said primary piston rod and force input assembly in said second position with said primary and secondary chambers being empty;

(D) moving said force input assembly from said second position to said first position with sufficient force to draw a volume $V_1$ of said fluid, by suction, from said source into said primary chamber to fill said primary chamber;

(E) moving said frame such that said carriage assembly is brought into lifting engaging with a massive object to be lifted;

(F) applying an input force $F_1$ to said force input assembly after said primary chamber is filled with said fluid to move said force input assembly and primary piston from said first position back to said second position to transfer a volume $V_1$ of said fluid from said primary chamber to each of said secondary chambers in equal proportions to raise each said secondary piston rod in unison, said carriage assembly and said object by a first incremental distance, less than the full upward extension of each said secondary piston rod.

31. The method of claim 30, the steps of which further comprise repeating step (D) and (F), in that order, at least once more in order to raise each said secondary piston rod by a second incremental distance up to said full upward extension of each said secondary piston rod.

32. The method of claim 30, the steps of which further comprise removing said force $F_1$ from said force input assembly following the step (F), moving said force input assembly from said second position back to said first position, and, thereafter, applying a third force to said force input assembly to move said frame and object as previously lifted from one location to another.

33. The method of claim 30, the steps of which further comprise selectively releasing hydraulic fluid from each of said secondary chambers back to said source under the influence of the weight of said carriage assembly and object bearing upon each said secondary piston rod while restraining said fluid from flowing from said secondary chambers back to said primary chamber.

* * * * *